US006000262A

United States Patent [19]

Dries et al.

[11] Patent Number: 6,000,262

[45] Date of Patent: Dec. 14, 1999

[54] APPARATUS AND METHOD FOR PRODUCING OPEN-TOPPED CYLINDRICAL CONTAINERS FROM CLOSED-TOPPED CYLINDRICAL CONTAINERS

[75] Inventors: William C. Dries, 6226 N. Highlands Ave., Madison, Wis. 53705; Bruce Winkler, Madison, Wis.

[73] Assignee: William C. Dries, Madison, Wis.

[21] Appl. No.: 09/133,138

[22] Filed: Aug. 12, 1998

Related U.S. Application Data

[60] Provisional application No. 60/058,362, Sep. 10, 1997.

[51] Int. Cl.[6] ..... B21D 51/38

[52] U.S. Cl. ..... 72/70; 72/125

[58] Field of Search ..... 72/70, 71, 72, 72/112, 125

[56] References Cited

U.S. PATENT DOCUMENTS

| | | | |
|---|---|---|---|
| 1,370,557 | 3/1921 | Pierce | 72/125 |
| 1,921,754 | 8/1933 | Hyde | 470/69 |
| 1,959,378 | 5/1934 | Magill . | |
| 3,394,572 | 7/1968 | Van Allman | 72/352 |
| 3,477,263 | 11/1969 | Jepson et al. | 72/71 |
| 4,125,941 | 11/1978 | McKinley . | |
| 4,633,589 | 1/1987 | Gray . | |
| 5,133,234 | 7/1992 | Ehlert et al. . | |
| 5,205,195 | 4/1993 | Crosslen et al. . | |
| 5,347,720 | 9/1994 | Pereira . | |
| 5,740,612 | 4/1998 | Takeshita et al. . | |

*Primary Examiner*—Lowell A. Larson
*Attorney, Agent, or Firm*—DeWitt Ross & Stevens S.C.

[57] ABSTRACT

Apparata and methods are shown and described for converting closed-topped containers, e.g., common aluminum beverage cans and steel food cans, into open-topped containers having open top mouths surrounded by a smooth rounded lip. In a preferred version of the invention, a closed-topped container, e.g., an aluminum can, is inserted within a casing so that its top protrudes outwardly therefrom. A tubular ram having a cutter situated therein is inserted over the can top and rotated with respect to the can to sever the can top from the remainder of the can. The ram is then withdrawn and inverted to reveal an annular bending groove facing the cut upper can sidewall. The ram is then screwed onto the casing to bring the bending groove onto the cut upper can sidewall, thereby bending a rolled lip on the can sidewall. The closed-topped can is thus converted into a cup-like open-topped container.

20 Claims, 5 Drawing Sheets

FIG. 3
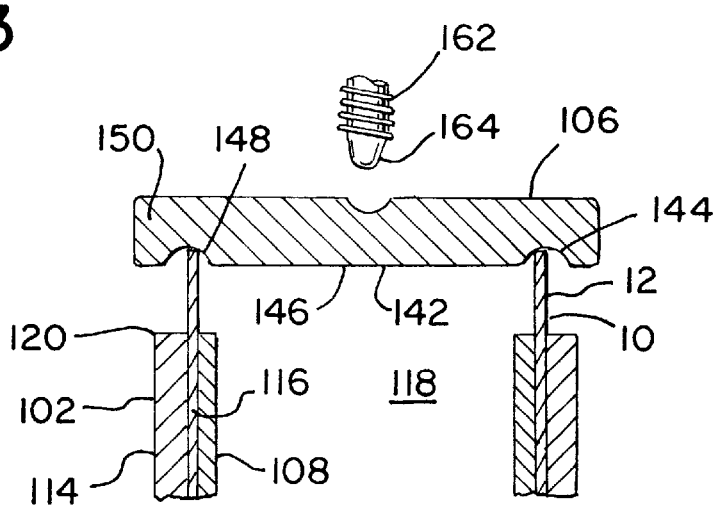
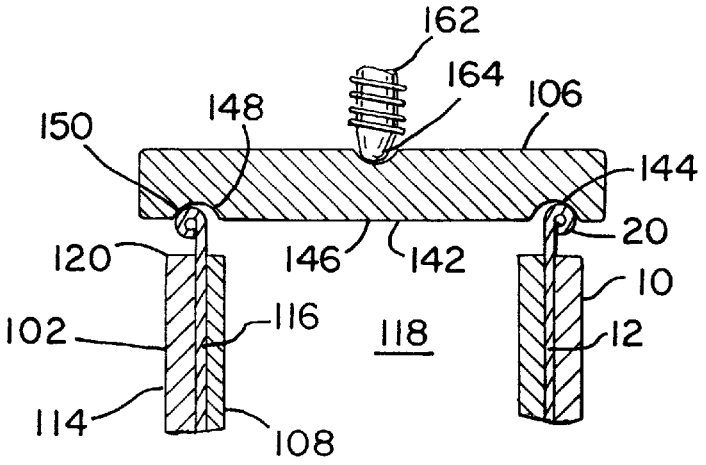
FIG. 4
FIG. 5
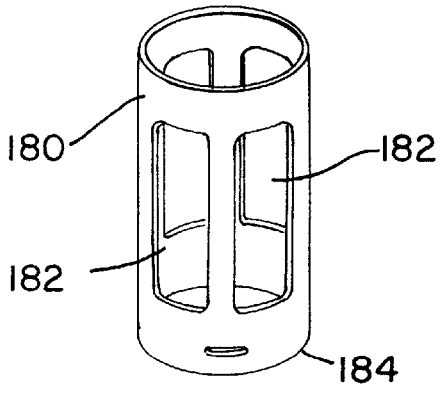

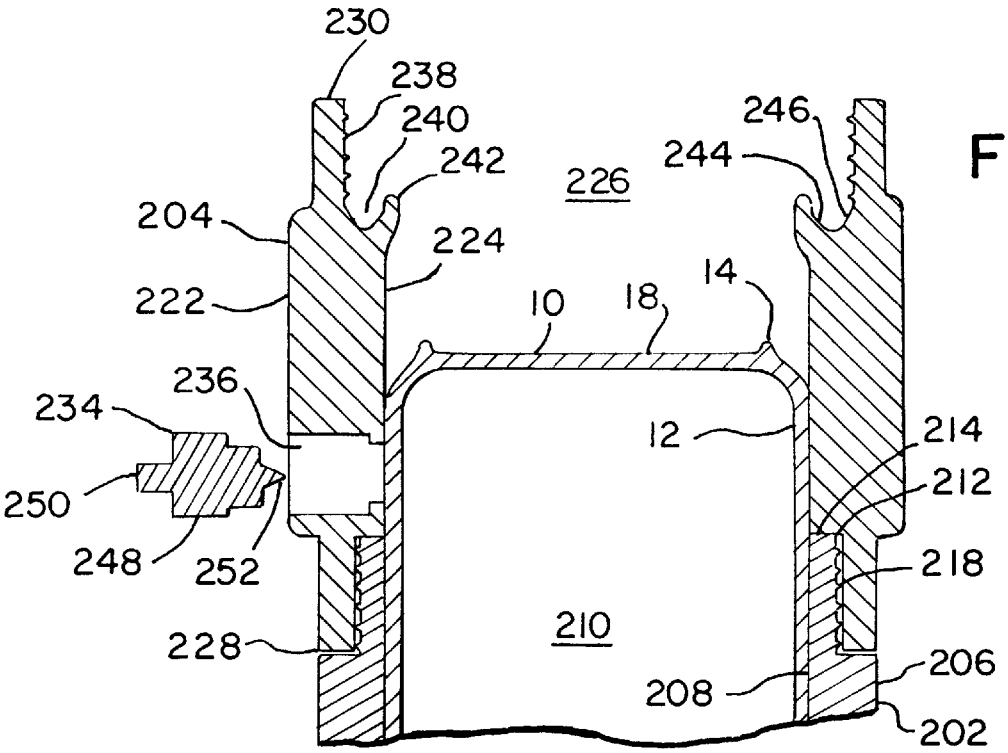
FIG. 9
FIG. 10
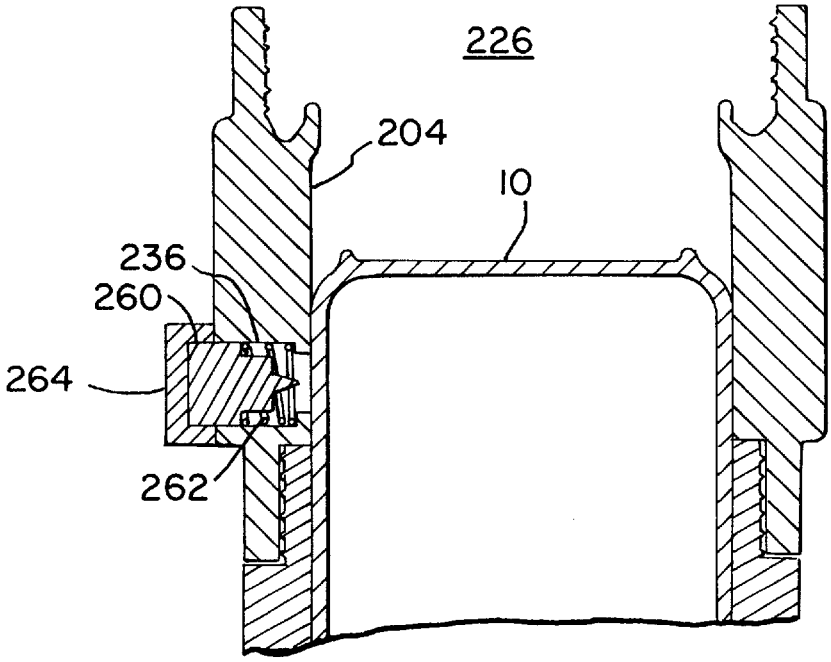

APPARATUS AND METHOD FOR PRODUCING OPEN-TOPPED CYLINDRICAL CONTAINERS FROM CLOSED-TOPPED CYLINDRICAL CONTAINERS

CROSS-REFERENCE TO RELATED APPLICATIONS

This application claims priority under 35 USC §119(e) to U.S. Provisional Patent Application Ser. No. 60/058,362 filed Sep. 10, 1997, the entirety of which is incorporated by reference herein.

FIELD OF THE INVENTION

This disclosure concerns an invention relating generally to recycling and conversion of discarded articles into useful articles, and more specifically to apparata and methods for modifying discarded containers having closed tops and bottoms into open-topped cylindrical containers.

BACKGROUND OF THE INVENTION

Discarded containers, e.g., aluminum beverage cans and steel food cans, are collected for recycling in many parts of the United States owing to the material and energy costs previously invested in these containers. Still, in many areas of the United States and throughout the world, particularly in rural areas of the United States and in developing countries, effective recycling programs are not in place. Without recycling, most discarded containers have no significant value after they are emptied of their original contents. Some containers, however, have tops or bottoms which are entirely open, which makes them suitable for reuse. As an example, small cans with open tops may be used as to harbor plant seedlings until they are large enough to survive when planted in the general environment. Many other cans have tops and/or bottoms which are not fully opened (i.e., their entire tops and/or bottoms are not removed), and instead the can is emptied by using a V-point bottle opener or a lever-actuated tab to form a small hole in the container top. These cans cannot be effectively reused because the small openings formed in the cans make them difficult to fully refill and re-empty. Additionally, even where the entire tops and/or bottoms of the cans are removed by use of a can opener, a sharp metal edge is left on the can top and/or bottom. This makes the can dangerous to reuse since the user's hand (or other articles inserted within the container) may be cut upon entry to or withdrawal from the can.

SUMMARY OF THE INVENTION

The invention, which is defined by the claims set out at the end of this disclosure, is directed to a recycling apparatus and method for converting containers having tops and/or bottoms which are at least partially closed into containers having fully opened tops and/or bottoms. The resulting containers can be used as general-purpose storage vessels or as cups for drinking or other purposes, and can be equipped with lids made of plastic or other materials to allow their reuse in packaging applications.

To summarize the invention, it will initially be helpful to describe a preferred method of converting containers in the aforementioned manner. A container having a cylindrical sidewall terminating in a container top and a container bottom is cut about the circumference of its sidewall to sever the top or bottom from the remainder of the container. (For the sake of simplicity, this Summary will henceforth describe the method and apparatus in the case where the container top is severed). The cut edge of the sidewall then defines an open top mouth on the container. The cut edge of the sidewall is then preferably bent to form a rolled lip, thereby forming the a smooth open top mouth on the container which avoids injury to a user's hand or other objects inserted into the top mouth. Additionally, the lip enhances the structural integrity of the container and deters crushing.

An apparatus in accordance with the invention may be provided by a casing which receives the container, a cutter, and a bending ram. The casing includes a casing exterior surface and an opposing casing interior surface, wherein the casing interior surface defines a generally cylindrical casing cavity. The casing cavity opens upon the casing exterior surface at a casing mouth. The casing mouth and casing cavity are sized to allow insertion of a container into the casing mouth with the container sidewall being received in the casing cavity closely adjacent to the container interior surface. During insertion of the container into the casing, the container sweeps a path which will be referred to below as the container insertion path.

The cutter, which is preferably situated on at least one of the casing interior surface and the bending ram, is then situated within the container insertion path so that it may be used to cut the container sidewall and sever the container top from the remainder of the container. The cutter is preferably removable from the container insertion path so that after cutting, it may be withdrawn to prevent later interference with objects traveling along the container insertion path (e.g., the cut container and/or its severed container top).

The bending ram, which includes a bending groove thereon, is movable along the container insertion path so that it may engage the cut edge of the container sidewall with this cut edge situated within the bending groove. As the bending ram is advanced toward the container bottom along the container insertion path, the cut edge of the container sidewall is bent by the bending groove to form a rolled lip at the top mouth of the container. Preferably, the bending ram is screw-actuated to move along the container insertion path toward and away from the casing mouth so that the motion of the bending ram is regulated, thereby beneficially providing an even and well-formed rolled lip. To better support the container sidewall during the lip-bending step and prevent it from undesirably bending at areas apart from the cut edge, a support plug which is sized to fit within the container sidewalls may be installed inside the container prior to advancing the bending ram onto the container.

In one preferred embodiment of the apparatus (exemplified by the apparatus of FIG. 1), the cutter is removably insertable into the casing from the casing exterior surface to protrude from the casing interior surface. A frame is provided wherein the casing may be received, and wherein the frame includes an actuator which moves the bending ram along the container insertion path toward and away from the casing cavity mouth. Thus, a user may insert the container within the casing, top first; insert the cutter within the casing to puncture the container; rotate the container within the casing to sever the container top from the remainder of the container; remove the cutter and severed container top from the casing; invert the container within the casing so that the cut edge of the container sidewall protrudes from the casing mouth; insert the support plug within the container sidewall; insert the casing within the frame; and advance the bending ram onto the cut edge of the container sidewall by use of the actuator until a rolled lip is bent. The bending ram may then be withdrawn, the casing may be removed from the frame, and a completed open-topped container may then be removed from the casing. If desired, the aforementioned process can then be repeated on the open-topped container to produce a tube having rolled lips at both its top and its bottom.

In a second preferred embodiment of the apparatus (exemplified by the apparatus of FIGS. 6–8), the bending ram includes a bending ram interior surface which defines a generally cylindrical bending ram cavity sized to closely receive the container sidewall. Preferably, the bending ram has a tubular configuration such that the bending ram cavity opens onto opposing ends of the bending ram. The cutter protrudes from the bending ram interior surface, and is preferably removably insertable into the bending ram exterior surface to extend into the bending ram cavity. A bending groove is also provided on the bending ram interior surface, preferably at a bending ram end opposite the cutter. A user may then form an open-topped container from a closed-topped container by inserting a container within the casing so that the container top protrudes from the casing mouth; fitting the bending ram atop the casing so that the container top rests within its bending ram cavity adjacent the cutter; rotating the bending ram with respect to the casing (and container) to draw the cutter about the circumference of the container, thereby severing the container top from the remainder of the container; removing the bending ram and inserting the support plug within the container sidewall; inverting the bending ram and replacing it atop the casing and container so that the bending groove is situated atop the cut edge of the container sidewall; and advancing the bending ram onto the container sidewall to form a rolled lip thereon. The bending ram may then be withdrawn and a completed open-topped container may be removed from the casing.

A third preferred embodiment of the apparatus is exemplified by the apparatus of FIG. 11. This apparatus is generally the same as the second preferred embodiment noted above, but the cutter is situated within the casing rather than the bending ram, similarly to the first preferred embodiment noted above. Thus, the third embodiment generally utilizes the cutting steps of the first embodiment and the lip-bending steps of the second embodiment.

The invention therefore provides apparata and methods for quickly and easily converting discarded closed-topped containers into useful open-topped containers. The second and third embodiments summarized above and are particularly preferred because they provide bending rams and casings which may be screwed together to form a singlepiece unit for easy handling and storage. Further advantages, features, and objects of the invention will be apparent from the following Detailed Description of the Invention in conjunction with the associated drawings.

BRIEF DESCRIPTION OF THE DRAWINGS

FIGS. 3–4 are partial sectional views of the apparatus of FIG. 1, shown in side elevation, illustrating the formation of a lip on the sidewall 12 of a container.

FIG. 5 is a perspective view of an alternate casing 180 suitable for use in place of casing 102 in FIG. 1.

FIG. 9 is a partial sectional view of the apparatus of FIGS. 6–8, shown in side elevation, prior to cutting the container top from the container 10.

FIG. 10 illustrates an alternate embodiment of the apparatus of FIG. 9 illustrating a spring-loaded container sidewall cutter 260.

DETAILED DESCRIPTION OF PREFERRED EMBODIMENTS OF THE INVENTION

Figure 6:
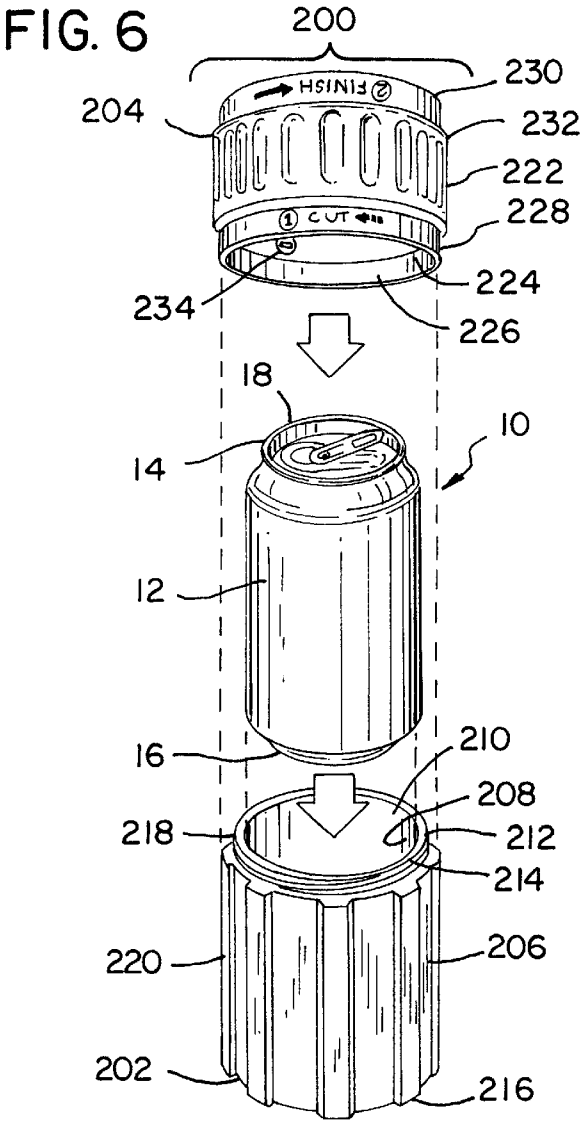
FIG. 6 is a perspective view of a second preferred embodiment of the apparatus of the invention, shown with a standard beverage container 10.

Prior to reviewing the invention in detail, it will initially be helpful to review an exemplary container suitable for modification by the apparatus and method of the present invention. Such a container is illustrated in FIG. 6 at 10, and includes a cylindrical tubular sidewall 12 terminating in a container top 14 and an opposing container bottom 16. The container bottom 16 is closed by a container floor (not shown), which is often integrally formed with the container sidewall 12. The container top 14 is at least partially closed by a container lid 18, which may include lever-actuated tabs or other opening mechanisms, or which may alternatively have a continuous surface which must be opened by a container opener. In either case, once the container lid 18 is opened, the container 10 is not well suited for use as a vessel because (1) the container lid 18 may still substantially close the container 10 (as is the case with the container illustrated in FIG. 6); and/or (2) removal of the container lid 18 and/or a portion of the container sidewall 12 will leave a cut metal edge which is sharp, and which can damage articles being inserted into and removed from the container 10. The apparata and methods of the present invention are intended to overcome these disadvantages, and provide a means for readily modifying a closed-top container into an open-top container, most preferably an open-top vessel wherein the borders of the open top are smooth and safe.

Figure 1:
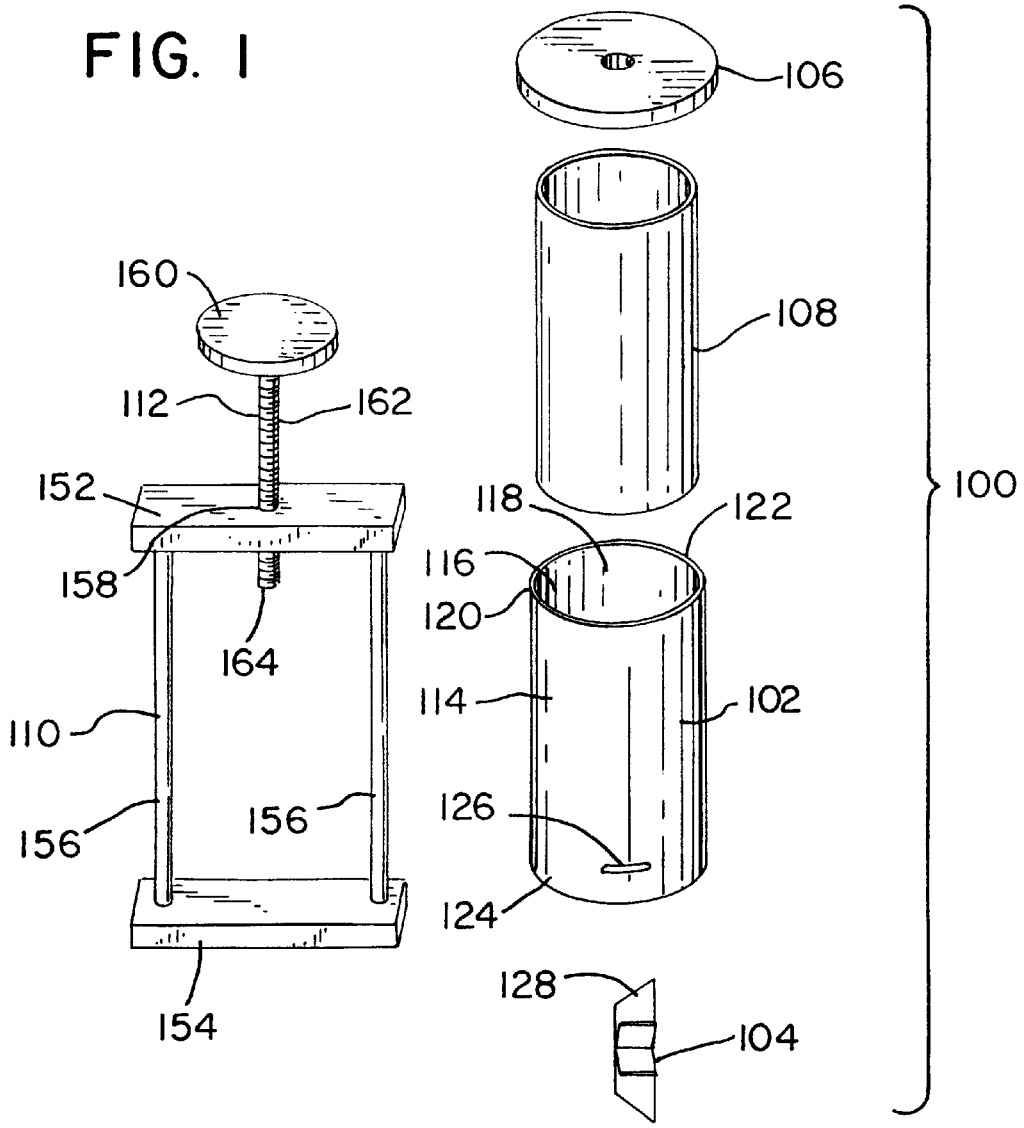
FIG. 1 is an exploded perspective view of a first preferred embodiment of the apparatus of the invention.

Referring then to FIG. 1, a first embodiment of an apparatus in accordance with S the invention is designated generally by the reference numeral 100. The apparatus 100 includes a casing 102, a cutter 104, a bending ram 106, a plug 108, and a frame 110, which is shown with an actuator 112 inserted therein. Each of these components will now be discussed in turn.

The casing 102 is preferably generally cylindrical in shape, and includes an exterior surface 114 and an opposing interior surface 116. The interior surface 116 defines a generally cylindrical casing cavity 118. The exterior and interior casing surfaces 114 and 116 include a casing top 120 which has a mouth 122 opening onto the casing cavity 118, and an opposing casing bottom 124 which is closed to define a casing floor (not shown). The casing cavity 118 is preferably sized with a diameter such that it closely receives a container sidewall 12 therein with the container sidewall 12 resting closely adjacent the casing interior surface 116, and so that the casing cavity 118 has a depth between the casing top 120 and casing bottom 124 such that a container 10 protrudes slightly out of the casing mouth 122, e.g., by 0.33 inches or so. The casing 102 additionally includes a cutter aperture 126 which extends from the casing exterior surface 114 to the casing interior surface 116. As will be discussed at greater length below, the cutter 104 may be inserted within this cutter aperture 126 so that it is situated within the casing cavity 118 to cut a container situated therein.

Figure 2:
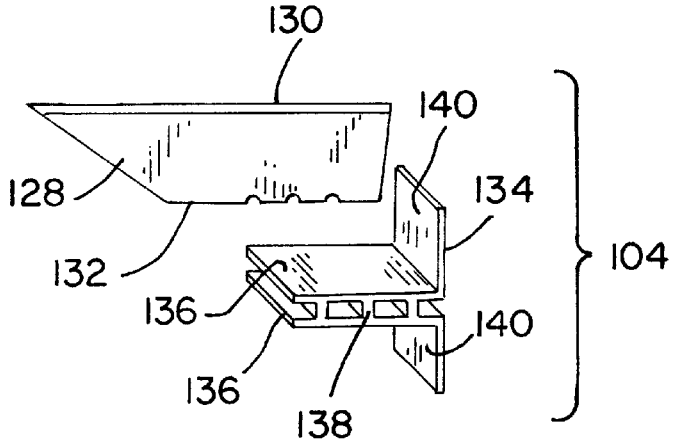
FIG. 2 is an exploded perspective view of the container sidewall cutter 104 of the apparatus of FIG. 1.

The cutter 104, which is illustrated in greater detail in FIG. 2, is intended to allow cutting of the container 10 when it is inserted within the casing 102. More specifically, with reference to FIG. 1, a container 10 may be inserted into the casing cavity 118 until it abuts the floor of the casing bottom 124, the cutter 104 may be inserted within the cutter aperture 126 to pierce the container sidewall 12, and the container 10 may then be rotated within the casing cavity 118 for a full revolution, thereby severing the container top 14 (or bottom 16) from its sidewall 12. Returning to FIG. 2, the preferred cutter 104 for the apparatus 100 utilizes a standard utility knife blade 128 having a sharp edge 130 and an opposing notched edge 132. A blade mount 134 is then provided with opposing blade fixture plates 136 which are spaced apart by bridges 138 to such an extent that the blade 128 may fit between the blade fixture plates 136. The bridges 138 are themselves spaced to engage the notched edge 132 of the blade 128. Protruding stops 140 then extend from the blade fixture plates 136 in such a fashion that when the blade 128 is affixed within the blade mount 134 and the blade mount 134 is then inserted within the cutter aperture 126, the stops 140 serve to contact the casing exterior surface 114 and prevent the blade 128 and blade mount 134 from being so far inserted within the cutter aperture 126 that they fall into the casing cavity 118. Thus, the cutter 104 may be easily inserted within the casing 102 to rest within the path of the container 10, and it may later be withdrawn for replacement of a dull blade 128 or for other purposes. The cutter 104 can loosely fit within the cutter aperture 126 to be maintained therein by a user's thumb during use of the apparatus 100, or it may fit so snugly within the cutter aperture 126 that it is firmly held therein until removed by the user.

The ability to removably insert the cutter 104 within the casing 102 is particularly advantageous in that full insertion of a container 10 within the casing cavity 118 is made easier if the cutter 104 is not present within the path of the container 10 during insertion. However, it is noted that some containers 10 made of softer material (e.g., aluminum) can be fully inserted within the casing cavity 118 even with the cutter 104 present in their path, though the leading face of the container 10 will experience damage (which is not disadvantageous if that face is to be later cut away). A cutter which is removably insertable within the casing 12 is nevertheless preferred because removal of a cut-away container top 14 (or bottom 16) from the casing 102 is made easier in casings 102 having non-removable casing bottoms 124 if the cutter 104 can be removed from the path of the severed top 14 while exiting the casing 102.

After a container 10 is inserted within the casing 102 and its container top 14 is cut away by use of the cutter 104, the cut container 10 is removed from the casing 102 (the cutter 104 and the cut-away container top 14 also preferably being removed at this time). The container 10 is then inverted and reinserted within the casing 102 so that its container bottom 16 is situated at the casing bottom 124, and so that its cut sidewall 12 protrudes out of the casing mouth 122. A user may then use the bending ram 106 and frame 110 to form a rolled lip 20 on the container sidewall 12, as will now be described in greater detail.

The bending ram 106, which is seen in greater detail in FIGS. 3 and 4, includes a bending ram face 142 bearing an annular bending groove 144 thereon which is sized to receive the cut container sidewall 12, as illustrated in FIGS. 3 and 4. The bending groove 144 is partially defined by a land 146 which is bounded by a first angled surface 148. A second angled surface 150 is then located radially outwardly of the first angled surface 148 to define the bending groove 144 between the two surfaces 148 and 150, with the bending groove 144 thereby surrounding the land 146.

Figure 8:
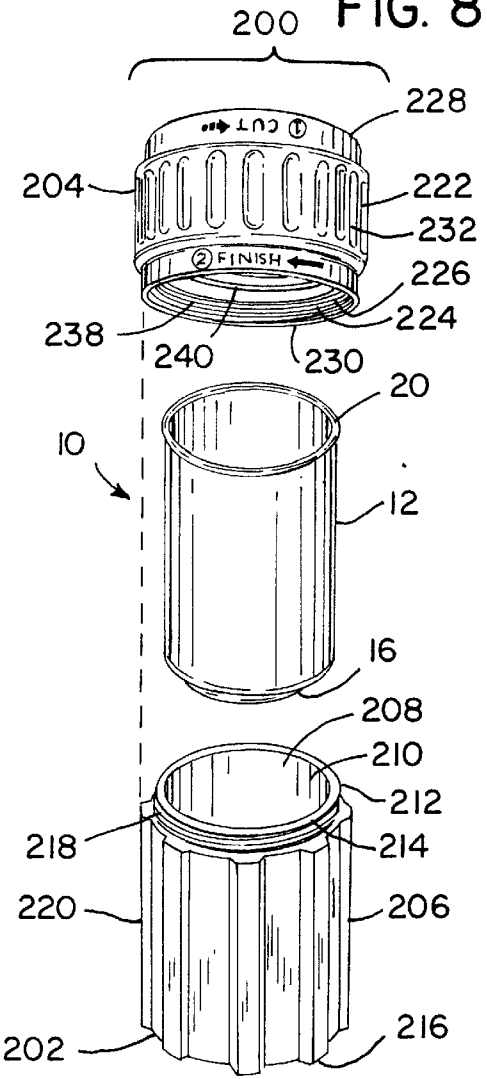
FIG. 8 illustrates the apparatus of FIGS. 6 and 7 after its bending ram 204 has been used to form a lip on the sidewall of the container 10.

Referring back to FIG. 1, the frame 110 includes first and second members 152 and 154 which are rigidly affixed in spaced relation by struts 156. The first member 152 bears an actuator aperture 158 wherein the actuator 112 is situated. The actuator 112 includes an actuation knob 160 affixed to an actuator screw 162 which is threaded within the actuator aperture 158. Opposite to the actuation knob 160, the actuator screw 162 terminates in a bending ram end 164. The members 152 and 154 and the struts 156 are spaced in such a fashion that the casing 102, with a cut container 10 resting therein, may be received between the members 152/154 and struts 156 with the casing bottom 124 abutting the second member 154, and with sufficient clearance between the first member 152 and the casing top 120 (and the top of the cut container 10) that the bending ram 106 may also be accommodated within the frame 110. More specifically, the bending ram 106 is fit atop the cut container 10 with the container sidewall 12 situated within the bending groove 144 (as shown in FIG. 3), and with clearance between the bending ram 106 and the bending ram end 164 of the actuator screw 162. By then rotating the actuation knob of 160 of the actuator 112, the bending ram end 164 of the actuator 112 is brought down on the bending ram 106. The bending ram 106 in turn bears onto the container sidewall 12. Initially, the container sidewall 12 contacts the first angled surface 148 and is bent outwardly. The container sidewall 12 then contacts the second angled surface 150 and is bent inwardly. This results in the formation of a rolled lip 20 as the bending ram 106 advances, as seen in FIG. 4. After the lip 20 is formed, the actuator screw 162 and bending ram 106 may be withdrawn, the casing 102 may be removed from the frame 110, and the container 10 (with the rolled lip 20 completed) may be removed from the casing 102. The container 10 has thus been formed into an open-topped vessel having a rolled top lip 20, as illustrated in FIG. 8.

In summary, the apparatus and method of the first embodiment of the invention described above may be characterized as follows:

1. A common closed-topped container, e.g., the container 10 of FIG. 6, is inserted within the casing 102. The portion of the container 10 to be cut away is inserted first; in the following summary, it will be assumed that the container top 14 is to be severed from the container 10 to form an open container top, and that the container bottom 16 will serve as the container's bottom.
2. The cutter 104 is then inserted within the cutter aperture 126 at the casing 102 to puncture the container sidewall 12 (if the cutter 104 was not already protruding from the interior surface 116 of the casing 102).
3. The casing 102 and container 10 are rotated relative to each other so that the cutter 104 travels about the circumference of the container sidewall 12, severing the container top 14 from the container sidewall 12.
4. The container 10, with its container top 14 now severed, is removed from the casing 102.
5. The cutter 104 may be removed from the cutter aperture 126 to clear the cutter 104 from the casing cavity 118, allowing easy removal of the severed container top 14 by simply inverting the casing 102.

6. The container 10 is then inverted and reinserted within the casing 102.
8. The casing 102 and container 10 is then inserted within the frame 110 between the second frame member 154 and the bending ram end 164 of the actuator 112.
9. The bending ram 106 is placed atop the cut container sidewall 12 with the container sidewall 12 resting within the bending groove 144.
10. The actuator 112 is screw-actuated to advance the bending ram 106 onto the container sidewall 12, thus bending the container sidewall 12 to form a rolled lip 20.
11. The actuator 112 is retreated to allow removal of the bending ram 106, in turn allowing the removal of the casing 102 and container 10 from the frame 110.
12. The container 10, which is now formed into an open-topped container as illustrated in FIG. 8, may then be removed from the casing 102 and is ready for use.

It is noted that the container 10 need not necessarily be inserted within the casing 102 prior to performing the lip-bending step, and could instead simply be inserted within the frame 110 without the casing 102 prior to bringing the bending ram 106 down on its container sidewall 12. However, it has been found that when the casing 102 is not used, the container 10 may have a tendency to crumple when the bending ram 106 is advanced, particularly if the container sidewall 12 bears any small dents. Thus, the casing 102 serves as a helpful means of supporting the container sidewall 12 when the lip 20 is bent. Additional support means may be provided by the plug 108 illustrated in FIGS. 1, 3, and 4. The plug 108 provides support for the interior of the container sidewall 12, and may be simply provided by a tube or other generally cylindrical shape which is sized to closely fit within the interior of the container sidewall 12 (as illustrated best by FIGS. 3 and 4).

It is also noted that the support provided by the casing 102 and/or plug 108 need not extend over the entirety of the container sidewall 12. To illustrate, FIG. 5 shows an alternate casing 180 which is substantially similar to the casing 102 of FIGS. 1, 3, and 4, but wherein a number of apertures 182 are provided about the circumference of the casing 180. The container sidewall 12 is thereby supported adjacent the container top 14 where the lip 20 is to be formed, at the container bottom 16, and at various areas along the container sidewall 12. The casing 180 additionally includes a casing bottom 184 which is open, with support of the container bottom 16 during lip-rolling being provided by the second member 154 of the frame 110. Advantageously, the open casing bottom 184 allows a severed container top 14 (or container bottom 16) to simply fall out of the casing 180 after it is severed from the remainder of the container 10.

The materials used to construct the aforementioned components of the first apparatus 100 must be chosen in accordance with the size, weight, and materials of the containers 10 they are to be used with. For example, where standard thin-walled aluminum beverage containers are to be modified in the first apparatus 100, plastic may be used for virtually every component, including the blade 128 of the cutter 104 (though metal blades 128 are preferred). This is additionally true where plastic cans or bottles are used. In contrast, heavier materials (such as steel) are recommended for constructing the first apparatus 100 if steel containers are to be cut.

Figure 7:
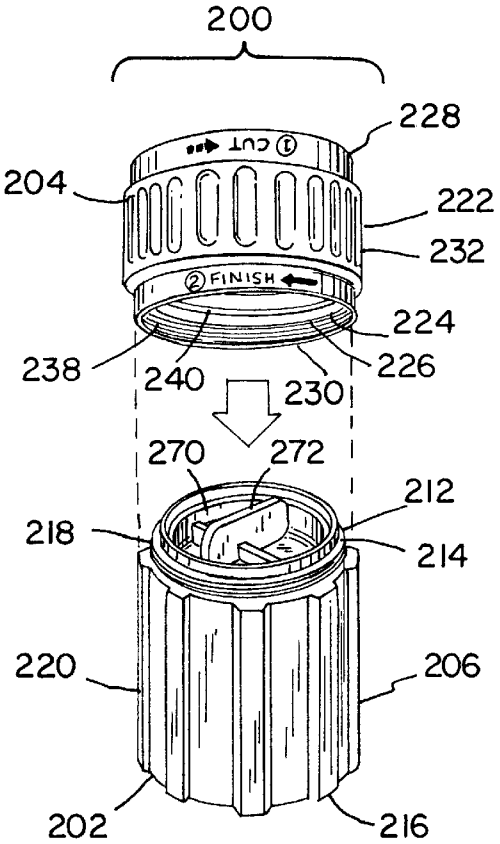
FIG. 7 illustrates the apparatus of FIG. 6 with the container 10 inserted within its casing 202, the container 10 having its container top cut away, and wherein a plug 270 is inserted within the interior of the container 10.

Referring now to FIGS. 6–8, a second and particularly preferred embodiment of the apparatus of the invention is illustrated. This embodiment is designated generally by the reference numeral 200 (it being noted, however, that the container 10 is not considered to form a part of the apparatus 200). The apparatus 200 can be considered to be conveniently provided in two main parts, a casing 202 and a bending ram 204, each of which will be discussed in turn below.

The casing 202 includes an exterior surface 206 and an opposing interior surface 208 which defines a generally cylindrical casing cavity 210. The casing 202 further has an open casing top 212 which defines a casing cavity mouth 214 opening onto the casing cavity 210, and an opposing casing bottom 216 which includes a casing floor (not shown) opposite the casing cavity mouth 214. A portion of the exterior casing surface 206 adjacent the casing top 212 preferably bears threading 218. Additionally, a major portion of the casing exterior surface 206 adjacent the casing bottom 216 preferably includes ridges 220 or other means for providing a reliable grip on the casing 202.

With particular reference to FIG. 6, the bending ram 204 includes a bending ram exterior surface 222 and an opposing bending ram interior surface 224 which defines a generally cylindrical bending ram cavity 226 sized to closely receive the container sidewall 12. Preferably, the bending ram 204 has a tubular configuration with the bending ram cavity 226 extending between open first and second bending ram ends 228 and 230. Similarly to the casing 202, the bending ram 204 preferably bears ridges 232 or other means for providing a sure grip on the bending ram 204 on its bending ram exterior surface 222. On the bending ram interior surface 224 adjacent the first bending ram end 228, a cutter 234 protrudes outwardly from the bending ram interior surface 224 into the bending ram cavity 226 to rest within the path of insertion that a container 10 follows when being inserted into the bending ram cavity 226. Referring particularly to FIG. 9, it can be seen that the cutter 234 is removably insertable into a cutter aperture 236 which extends from the bending ram exterior surface 222 to the bending ram interior surface 224 adjacent the first bending ram end 228. From FIG. 9, it can be seen that the diameter of the bending ram cavity 226 at the first bending ram end 228 is such that the threaded casing top 212 fits within the bending ram interior surface 224 without interfering with the casing threading 216, thereby allowing the bending ram 204 and casing 202 to freely rotate with respect to each other when the casing top 212 is fit within the first bending ram end 228.

As best shown in FIG. 7, the bending ram interior surface 224 adjacent the second bending ram end 230 bears threading 238 complementary to the threading 218 on the casing 202. Also on the bending ram interior surface 224 adjacent the second bending ram end 230, but situated between the threading 238 and the cutter 234, an annular bending groove 240 extends about the circumference of the bending ram interior surface 224. This bending groove 240 may be seen in greater detail in FIGS. 9 and 10, wherein the bending groove 240 can be seen to be partially defined by an annular land 242 extending from the bending ram interior surface 224. The land 242 is partially bounded by a first angled surface 244, which is situated radially inwardly from a second angled surface 246. The first and second angled surfaces 244 and 246 combine to define the bending groove 240, which surrounds the land 242 at its major diameter.

Looking now to FIG. 9, the cutter 234 will now be described in greater detail. The cutter 234 is preferably formed with an insertion body 248 sized to snugly fit within the cutter aperture 236, a cutter tab 250 which allows the cutter 234 to be more easily grasped and inserted/removed into the cutter aperture 236, and a protruding sharp edge 252, which may be provided by a blade or simply a sharp point. While the cutter 234 is preferably formed as a single integral piece, it could alternatively be formed in the same fashion as the cutter 104 of FIGS. 1–2, wherein a removable cutting blade or sharp point is provided for later economical replacement. FIG. 10 then illustrates an alternate cutter 260 which is biased away from the bending ram cavity 226 by a spring 262 interposed between the second cutter 260 and the bending ram 204, and wherein a rubber membrane 264 affixed to the bending ram 204 prevents the cutter 260 from falling out of the cutter aperture 236. Thus, pushing on the button-like membrane 264 will actuate the cutter 260 to place it within the path of the container 10, and releasing the membrane causes the cutter 260 to retract owing to action of the spring 262.

As noted above, it can be helpful to provide a means for supporting the container sidewall 12 from its interior. FIG. 7 illustrates a cylindrical plug 270 which may be used for this purpose, this plug 270 including a handle 272 which may be used to more easily insert and remove the plug 270 into the interior of the container 10. The handle 272 is sized such that it fits within the bending ram cavity 226 without interfering with the bending ram interior surface 224 when the bending ram 204 is fit atop the casing 202 (as can be best visualized with reference to the alternate embodiment of FIG. 11, which is discussed below).

A preferred mode of operation of the apparatus 200 will now be described with reference to FIGS. 6–9:

1. As shown in FIG. 6, the container 10 is inserted within the casing cavity 210 of the casing 202 so that the portion of the container 10 which is to define the open top protrudes outwardly from the casing cavity mouth 214. In FIGS. 6–9, the container top 14 is to be removed.
2. As shown in FIG. 9, the bending ram 204 is then brought downwardly towards the casing cavity 210 until the container top 14 rests within the bending ram cavity 226, with the container top 14 situated adjacent the cutter aperture 236 (and cutter 234, if present).
3. If the cutter 234 is not already present, it is inserted within the cutter aperture 236 to puncture the container sidewall 12 adjacent the container top 14.
4. The bending ram 204 and container 10 are then rotated with respect to each other, thereby drawing the cutter 234 about the circumference of the container sidewall 12 and severing the container top 14 from the remainder of the container 10.
5. The cutter 234 may then be withdrawn from the cutter aperture 236 to allow the separate container top 14 to be more easily removed from the first bending ram end 228.
6. The container 10 is then inverted and reinserted within the casing 202 so that its cut sidewall 12 protrudes from the casing top 212.
7. If desired, the plug 270 can then be inserted within the interior of the container 10 to better support the container sidewall 12, as illustrated in FIG. 7.
8. The bending ram 204 is then inverted so that the second bending ram end 230 faces the casing cavity mouth 214, and the bending ram 204 is brought downwardly to engage the bending ram threading 238 with the casing threading 218. The bending ram 204 and casing 202 are screwed together, bringing the bending groove 240 on the bending ram interior surface 224 downwardly onto the cut container sidewall 12. As the bending ram 204 is advanced with respect to the casing 202, the container sidewall 12 is bent to form a rolled lip in the manner described above for the first apparatus 100.
9. The bending ram 204 and casing 202 are then unscrewed and the plug is removed, allowing removal of the finished container (illustrated in FIG. 8) to be removed from the casing 202.

It is noted that if the container 10 does not fit so snugly within the casing 202 that it does not slip when cutting occurs (i.e., if the rotation of the bending ram 204 causes the container 10 to rotate within the casing 202, rather than having the container 10 stay in place as the cutter 234 traverses its circumference), one or more apertures may be formed in the casing 202 to allow the user to partially grasp the container sidewall 12 when the bending ram 204 is rotated.

Figure 11:
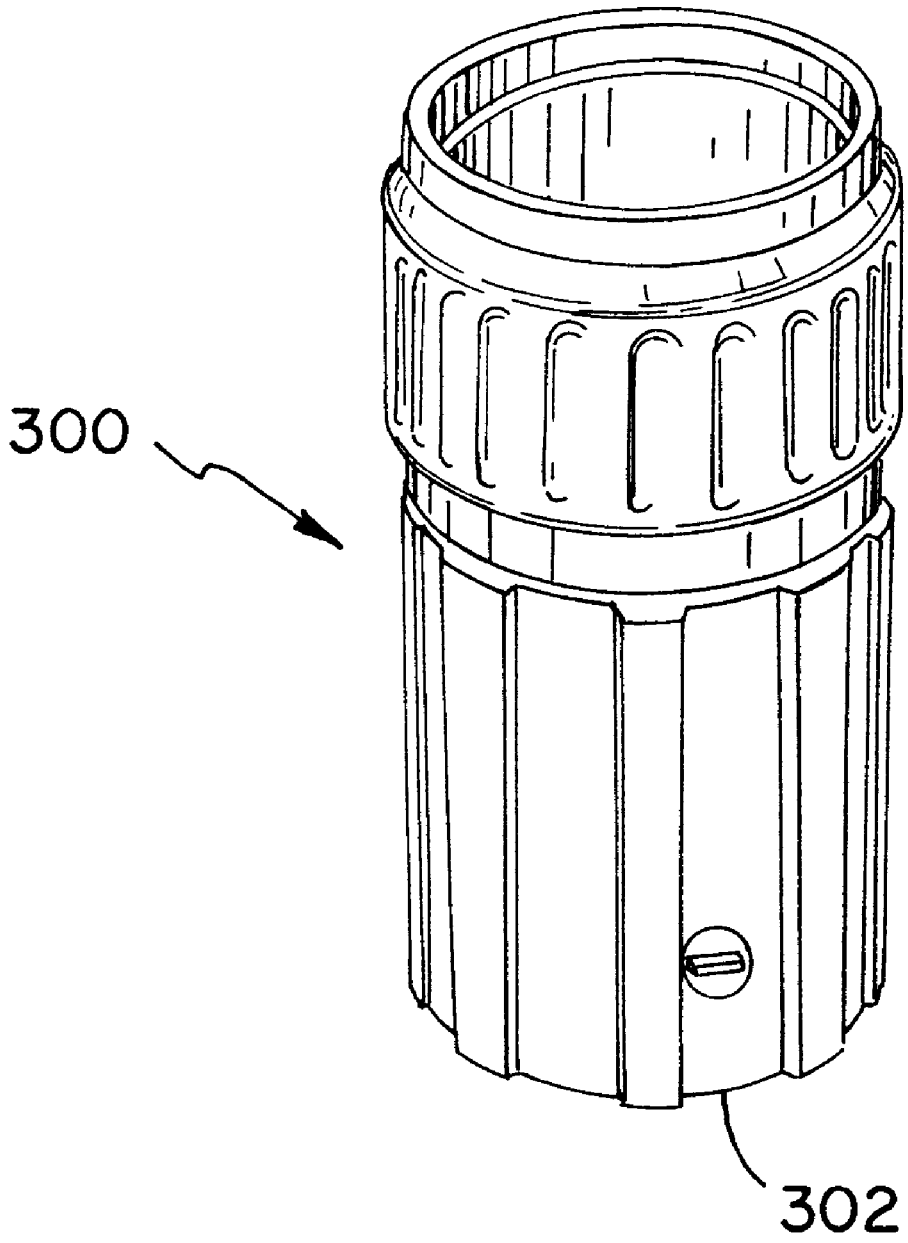
FIG. 11 is a third preferred embodiment of the apparatus of the invention, this embodiment generally corresponding to that of FIGS. 6–10 but having a different location for the container sidewall cutter 302.

FIG. 11 then illustrates a third embodiment of the apparatus, indicated generally by the reference numeral 300. This apparatus 300 includes a casing 202 and bending ram 204 similar to those of the apparatus 200, but in this case the casing 202 is similar to the casing 102 of the first apparatus 100 insofar as it includes a cutter 302 removably inserted therein. Thus, the apparatus 300 utilizes cutting steps similar to those of the first apparatus 100 and lip-forming steps similar to those of the apparatus 200.

It is understood that preferred embodiments of the invention have been described above in order to illustrate how to make and use the invention. The invention is not intended to be limited to these embodiments, but rather is intended to be limited only by the claims set out below. Thus, the invention encompasses all alternate embodiments that fall literally or equivalently within the scope of these claims. It is understood that in the claims, means plus function clauses are intended to encompass the structures described above as performing their recited function, and also both structural equivalents and equivalent structures. As an example, though a nail and a screw may not be structural equivalents insofar as a nail employs a cylindrical surface to secure parts together whereas a screw employs a helical surface, in the context of fastening parts, a nail and a screw are equivalent structures.

What is claimed is:

1. An apparatus for forming an open-topped container from a closed-topped container having a container sidewall terminating in a container top and an opposing container bottom, the apparatus comprising:

a. a casing including
   (1) a casing exterior surface, and
   (2) a casing interior surface which defines a casing cavity sized for closely receiving the container sidewall, wherein the path swept by the container during such receiving defines a container insertion path;

b. a cutter situated within the container insertion path;

c. a bending ram movable along the container insertion path, wherein the bending ram includes a bending groove sized to fit atop the container sidewall.

2. The apparatus of claim 1 further comprising a support plug sized to closely fit within the container sidewall.

3. The apparatus of claim 1 wherein the cutter is retractable from the container insertion path, and also insertable therein.

4. The apparatus of claim 1 wherein the bending groove is annular.

5. The apparatus of claim 1 wherein the bending ram is screw-actuated to move along the container insertion path.

6. The apparatus of claim 5 wherein the bending ram and casing bear complementary threading, whereby the bending ram is movable along the container insertion path by screwing it onto the casing.

7. The apparatus of claim 1 wherein the bending ram includes a bending ram interior surface which defines a generally cylindrical bending ram cavity, the bending ram cavity being sized to closely receive the container sidewall, and further wherein the cutter protrudes from the bending ram interior surface.

8. The apparatus of claim 7 wherein the bending ram is generally tubular, with the bending ram including opposing bending ram ends onto which the bending ram cavity opens, and further wherein the cutter and bending groove are each situated near one of the bending ram ends.

9. The apparatus of claim 1 wherein the bending ram includes a bending ram exterior surface and a generally tubular bending ram interior surface encircling a bending ram cavity, wherein the cutter and bending groove are located on the bending ram interior surface.

10. The apparatus of claim 9 wherein the cutter is removably insertable from the bending ram exterior surface.

11. The apparatus of claim 9 wherein the bending ram and casing bear complementary threading, whereby the bending ram is movable along the container insertion path by screwing it onto the casing.

12. The apparatus of claim 1 wherein the cutter protrudes from the casing interior surface.

13. The apparatus of claim 12 wherein the cutter is removably insertable from the casing exterior surface.

14. The apparatus of claim 1 wherein the casing includes a. a casing mouth opening onto the casing cavity, and b. a casing bottom situated opposite the casing mouth, wherein the cutter protrudes from the casing interior surface at a location closer to the casing bottom than the casing mouth.

15. The apparatus of claim 14 wherein the casing includes a casing floor extending at least partially across the casing bottom.

16. The apparatus of claim 1 further comprising a frame into which the casing is received, the frame including an actuator bearing the bending ram, whereby the actuator moves the bending ram along the container insertion path.

17. The apparatus of claim 16 wherein the cutter protrudes from the casing interior surface.

18. An apparatus for forming an open-topped container from a closed-topped container having a container sidewall terminating in a container top and an opposing container bottom, the apparatus comprising:

a. a casing including a casing interior surface which defines a casing cavity sized to closely receive the container sidewall, wherein the casing cavity opens at a casing mouth;

b. a bending ram including a bending groove defined thereon;

c. a cutter protruding from at least one of the bending ram and the casing interior surface, wherein the bending ram is screw-actuated to move toward and away from the casing mouth.

19. The apparatus of claim 18 wherein the bending ram includes a bending ram interior surface which defines a generally cylindrical bending ram cavity, and wherein the bending groove is defined on the bending ram interior surface, and further wherein the cutter protrudes from at least one of the bending ram interior surface and the casing interior surface.

20. The apparatus of claim 18 wherein the bending ram and casing bear complementary threading.

* * * * *